US005689900A

United States Patent [19]

Takayama et al.

[11] Patent Number: 5,689,900

[45] Date of Patent: Nov. 25, 1997

[54] DRYING APPARATUS AND DRYING METHOD

[75] Inventors: Gen Takayama, Kanagawa-ken; Tsutomu Horikoshi, Saitama-ken; Shigeo Kasahara, Kanagawa-ken; Yoshiyuki Sakai, Shizuoka-ken; Toshihiko Kusago, Shizuoka-ken; Yasuhiro Kuroki, Shizuoka-ken, all of Japan

[73] Assignees: Toshiba Battery Co., Ltd.; Toshiba Kikai Kabushiki Kaisha, both of Tokyo, Japan

[21] Appl. No.: 700,001

[22] Filed: Aug. 20, 1996

[30] Foreign Application Priority Data

Aug. 21, 1995 [JP] Japan ..... 7-211674
Aug. 21, 1995 [JP] Japan ..... 7-211766

[51] Int. Cl.[6] ..... F26B 13/00

[52] U.S. Cl. ..... 34/631; 34/638; 34/639; 34/643; 34/644

[58] Field of Search ..... 34/614, 618, 621, 34/629, 631, 637, 638, 639, 643, 644, 655

[56] References Cited

U.S. PATENT DOCUMENTS

| | | | |
|---|---|---|---|
| 1,795,612 | 3/1931 | Lormor | 34/614 X |
| 4,017,982 | 4/1977 | Goffredo | 34/639 X |
| 4,115,181 | 9/1978 | Fujii et al. | 156/497 |
| 4,693,014 | 9/1987 | Calflisch et al. | 34/464 |
| 5,345,696 | 9/1994 | Bosoni | 34/638 |

*Primary Examiner*—John M. Sollecito
*Assistant Examiner*—Steve Gravini
*Attorney, Agent, or Firm*—Finnegan, Henderson, Farabow, Garrett & Dunner, L.L.P.

[57] ABSTRACT

Air-blowing nozzles 21 for blowing a hot air are provided in both sides of an electrode sheet 33 for a battery both surfaces of which an electrode compounding agent has been applied to. In each of the air-blowing nozzles 21, a pair of slit-shaped blowholes 65 being extended in the width direction of the electrode sheet 33 are provided on both of the upper and lower sides of the end face part 63. The hot air blown off from a pair of the upper and lower blowholes 65 dries the electrode compounding agent as well as pressurizes a space between the electrode sheet 33 and the end face part 63 to form a pressure room P, and the left and right pressure rooms P hold the electrode sheet 33 to suppress its sway.

3 Claims, 12 Drawing Sheets

DRYING APPARATUS AND DRYING METHOD

BACKGROUND OF THE INVENTION

1. Field of the Invention

The present invention relates to a drying apparatus and a drying method for drying a coating liquid in a process of conveying in the vertical direction a flexible beltlike sheet both surfaces of which the coating liquid has been applied to. In addition, the present invention relates to a skew-proceeding preventing apparatus which is provided with a turning part for changing the proceeding direction of a flexible beltlike sheet coming up from the inside of a drying furnace so as to enter again the sheet into the inside of the drying furnace and move it downward inside the drying furnace, on the top of the drying furnace for drying a coating liquid, and prevents a skew movement of said beltlike sheet in the width direction in the turn part.

2. Description of the Related Art

As a flexible beltlike sheet both surfaces of which a coating liquid has been applied to, for example, there is an electrode sheet for an electric battery both surfaces of which an electrode compounding agent has been applied to. In this case, as an example, an electrode sheet used for a nickel-hydrogen battery is explained. In the nickel-hydrogen battery, a nickel-plated nonwoven fabric is used as a base material for the anode and a stainless steel sheet is used as a base material for the cathode, and after an electrode compounding agent composed of nickel paste and water has been applied to the anode base material and an electrode compounding agent composed of hydrogen-absorbing alloy paste and water has been applied to the cathode base material, the applied electrode compounding agents are dried.

FIG. 1 shows schematically, as the first conventional art, a process of applying an electrode compounding agent to an electrode sheet and drying it. A coater 1 is disposed at the lower side, a dryer 3 is disposed at the upper side, and an electrode sheet 5 is conveyed upward between the lower roller 7 and the upper roller 9. A vessel 11 of the coater 1 is filled with an electrode compounding agent 13 and the electrode compounding agent 13 is applied to both surfaces of the electrode sheet 5 by conveying the electrode sheet 5 from downward to upward through the vessel 11, and the uniformly coated surfaces are secured by scraping away an excessive portion of the electrode compounding agent 13 with blades 15 disposed above the liquid surface of the electrode compounding agent 13. The dryer 3 is provided with air-blowing nozzles 19 disposed in both sides of the coated electrode sheet 5 inside a drying furnace 17, and the air-blowing nozzles 19 blow a hot air against the coated surfaces of the electrode sheet 5 moving upward to dry them.

Each of the air-blowing nozzles 19 has a blowhole and for example, the air-blowing nozzles 19 are disposed opposite to each other in both sides of the electrode sheet 5, or they are disposed so that the hot air blown off from the air-blowing nozzles 19 may flow slantly upward so as to make an air flow parallel with the electrode sheet 5.

By the way, there is not a holder to hold the electrode sheet 5 between the coater 1 and the upper roller 9 and furthermore, height of the drying furnace 17 is as much as about 6 m for the anode base material of a nickel-hydrogen battery and about 8 m for the cathode base material of it, so the electrode sheet 5 is liable to sway in the drying furnace 17. To greatly sway the electrode sheet 5 causes a problem that uniform coated surfaces cannot be obtained not only by having a bad influence upon the coated surface due to a fact that the coated film is made uneven in thickness inside the drying furnace 17 but also by having a bad influence upon the coating process in the coater 1.

In the first conventional art, therefore, since such a measure is taken that the air-blowing nozzles 19 are disposed at a great distance from the electrode sheet 5 or that the speed of a running air blown off from the air-blowing nozzles 19 is made as slow as possible, the drying efficiency has not been satisfactory.

In order to solve these problems, it is thought to keep high the temperature inside the drying furnace 17 or to make the drying furnace 17 higher so as to make longer the conveying distance inside the drying furnace 17. However, the former case causes an increase in cost due to requiring a measure of making greater the output of an electric heater and the latter case has not only a disadvantage that the drying apparatus is made larger but also a fatal weak point that the electrode sheet 5 is more liable to sway since the conveying distance of the electrode sheet 5 is made longer.

FIG. 2 shows schematically, as the second conventional art, a drying process of an electrode compounding agent applied to an electrode sheet and its peripheral area, and an electrode sheet 101 is conveyed vertically upward and downward in a drying furnace 103. The drying furnace 103 is mounted on a pedestal 105, and a turn part 107 to change the moving direction of the electrode sheet 101 from the upward direction to the downward direction is mounted on the top of the drying furnace 103.

A coater 113 a vessel 109 of which is filled with the electrode compounding agent 111 is provided below the drying furnace 103, and the electrode compounding agent 111 is applied to both surfaces of the electrode sheet 101 while the electrode sheet 101 is passing through inside the vessel 109. Nozzles 115 for blowing a hot air heated by, for example, an electric heater against the electrode sheet 101 are disposed inside the drying furnace 103, and the electrode compounding agent applied to the surfaces of the electrode sheet 101 is dried by the hot wind blown off from the nozzles 115. A turn roller 117 of large diameter which is wrapped in the electrode sheet 101 and can be driven to rotate is supported on the turn part 107 so as to be rotated through bearings 119, and they are covered with a heat-isolating hood 121 to reduce a temperature difference between the inside of the turn part 107 and the inside of the drying furnace 103.

By the way, there is not a holder to hold the electrode sheet 101 between the coater 113 and the turn roller 117 and furthermore, height of the drying furnace 103 is as much as about 6 m for an anode base material of a nickel-hydrogen battery and about 8 m for a cathode base material, so the electrode sheet 101 is liable to skew in its width direction at the turn roller 117.

Therefore, the turn roller 117 is composed so as to be fixed in general, but some of the turn rollers of comparatively rigid material such as metal are composed so as to rotate one bearing 119 of the turn roller 117 and move up and down the other bearing 119 in the vertical direction as shown by an arrow A to correct the skew movement. Detection of the skew movement is performed by monitoring the position of a side edge of the electrode sheet drawn out from the turn roller 117 by means of an edge position control (EPC) sensor 123, and the skew movement is corrected by moving the turn roller 117 upward or downward by means of a non-illustrated actuator according to a slippage between the detected position and a target position.

By the way, in case of moving the turn roller 117 upward or downward in order to correct a skew movement, since the electrode sheet 101 is moving upward in the left side of the turn roller 117 and is moving downward in the right side of the turn roller 117, a tension difference appears between the left and the right part of the electrode sheet 101. This phenomenon is remarkable in particular in case of a material of high rigidity such as metal, and there is a problem that a coated film is made uneven by a trouble of variation in thickness of the coated film or a trouble of occurrence of traverse stripes in the coated film caused by that the electrode sheet 101 in the lower-tension side sways from side to side under the influence of a hot wind inside the drying furnace 103.

SUMMARY OF THE INVENTION

The first object of the present invention is to improve a drying efficiency by suppressing sway of a beltlike sheet inside a drying furnace.

The second object of a second embodiment is to prevent a skew movement of a beltlike sheet without having a great influence upon tension of the beltlike sheet.

In order to attain the first object, according to one aspect of the invention, first, the present invention provides a drying apparatus having the construction in which a flexible beltlike sheet both surfaces of which a coating liquid has been applied to is conveyed in the vertical direction and the coating liquid is dried in the conveying process in the vertical direction, wherein air-blowing nozzles are disposed opposite to one another at a specified distance from the beltlike sheet which the coating liquid has been applied to, each of which air-blowing nozzles has an end face part facing the beltlike sheet and slit-shaped blowholes, which are provided in both sides of the end face part in the direction of conveying the beltlike sheet and are extended in the width direction of the beltlike sheet.

Second, in the first construction, the beltlike sheet is an electrode sheet for a battery both surfaces of which an electrode compounding agent is applied to.

Third, in the first or second construction, the air-blowing nozzles can be moved close to and apart from the beltlike sheet.

Fourth, the invention provides a drying method in which a flexible beltlike sheet both surfaces of which a coating liquid has been applied to is conveyed in the vertical direction and the coating liquid is dried in a conveying process in the vertical direction, wherein slit-shaped blowholes being extended in the width direction of the electrode sheet are disposed opposite to each other at a specified distance from the compounding-agent coated surface of the electrode sheet so as to put the electrode sheet between the blowholes which are disposed on both sides of the end face part of an air-blowing nozzle facing the electrode sheet one behind another in the direction of conveying the electrode sheet, and the coating liquid is dried as pressing the electrode sheet from both sides of it by making the air blown off from the two blowholes of each of the air-blowing nozzles form a pressure room between the electrode sheet and the end face part between the two blowholes.

According to the above-mentioned construction, since the air blown off from the two blowholes of the air-blowing nozzle flow toward an area between the two blowholes after being blown against the beltlike sheet, a space between the beltlike sheet and the end face part is pressurized to form a pressure room, and since such pressure rooms as this are formed on both sides of the beltlike sheet as the air-blowing nozzles are disposed opposite to each other so as to put the beltlike sheet between them, the pressure rooms in both sides of it press the beltlike sheet to suppress its sway.

In order to attain the second object, according to another aspect of the invention, first, the present invention provides a skew-movement preventing apparatus for a drying apparatus, provided with a turn part for changing the proceeding direction of a flexible beltlike sheet coming up from the inside of a dryer so as to enter again the beltlike sheet into the drying furnace and move it downward inside the drying furnace, on the top of the drying furnace for drying a coating liquid by moving in the vertical direction the flexible beltlike sheet both surfaces of which the coating liquid has been applied to in the previous process, wherein the turn part comprises;

- an entrance roller for turning the beltlike sheet coming up from the dryer to the horizontal direction,
- an exit roller for turning the beltlike sheet being drawn from the entrance roller to the downward direction,
- a supporting structure which supports the entrance roller and the exit roller so as to be rotated and can be swivelled horizontally in relation to the dryer around a pivot which is in a side part of the entrance roller opposite to the exit roller,
- a driving mechanism for swivelling the supporting structure,
- a position detector for detecting a position of a side edge of the beltlike sheet in its width direction which is being drawn out from the exit roller, and
- a controller for controlling action of the driving mechanism on the basis of a detection value of the position detector.

Second, in the first construction, the supporting structure is supported so as to be swivelled on the top surface of the drying furnace through a spherical member capable of rolling on it.

Third, in the second construction, a height adjusting mechanism capable of adjusting height of the supporting structure is provided on the top surface of the drying furnace at a position corresponding to each of the four corners of the lower surface of the supporting structure.

Fourth, in the first construction, the position detector has an air blowing hole facing one surface of the beltlike sheet in a peripheral area of one side edge of the beltlike sheet and a sensing part for detecting pressure of the air blown off from the air blowing hole opposite to the other surface of the beltlike sheet, and the position detector is a pneumatic position detector which detects a width-directional position of the beltlike sheet by comparing an air pressure detected by the sensing part with a target air pressure.

Fifth, in the first construction, through holes, formed respectively in the top plate of the drying furnace and in the bottom plate of the supporting structure, which the beltlike sheet passes through are linked with each other by means of elastically transformable ducts.

Sixth, in the first construction, the supporting structure has a housing for covering the entrance roller and the exit roller and has the bearings which support the respective rollers so as to be rotated and are set outside the housing, and the bearings for supporting the entrance roller so as to be rotated are provided on a tension detector for detecting tension of the beltlike sheet by converting a displacement caused by a force given from the beltlike sheet into an electric signal, and a tension adjuster for adjusting tension of the beltlike sheet according to a detection value of the tension detector is provided.

According to the first construction, the position detector detects a width-directional position of the beltlike sheet, and the controller controls a driving mechanism on the basis of the detection value to swivel the entire supporting structure provided with the entrance roller and the exit roller in the horizontal direction around the pivot and thus corrects a skew movement of the electrode sheet which changes its proceeding direction by means of the entrance roller and the exit roller.

According to the second construction, since the supporting structure is supported through spherical members which can roll on the top plate of the drying furnace, its swivelling action is smoothly performed.

According to the third construction, in case that the top plate of the drying furnace to be mounted with the supporting structure is transformed due to heating, inclination of the supporting structure is corrected by adjusting height of the supporting structure by means of the height adjusting mechanisms on the four corners of the top plate of the drying furnace.

According to the fourth construction, since the position detector is of pneumatic type, it is hard to be influenced by heat generated from the drying furnace and so its detection accuracy is kept at a desirable level.

According to the fifth construction, since the inside of the drying furnace and the inside of the turn part are linked with each other through the ducts, a temperature difference between them is kept little and a thermal influence upon the coated surfaces is also suppressed, and since the ducts are elastically transformable, they can follow a swivelling action of the supporting structure.

According to the sixth construction, although tension of the beltlike sheet is adjusted by the tension adjuster according to a detection value of the tension detector, since the tension detector is set outside the housing, the tension detector does not receive a thermal influence and keeps its detection accuracy at a desirable level.

DESCRIPTION OF THE PREFERRED EMBODIMENTS

Embodiments of the present invention will be described with reference to the accompanying drawings hereinafter.

Figure 3:
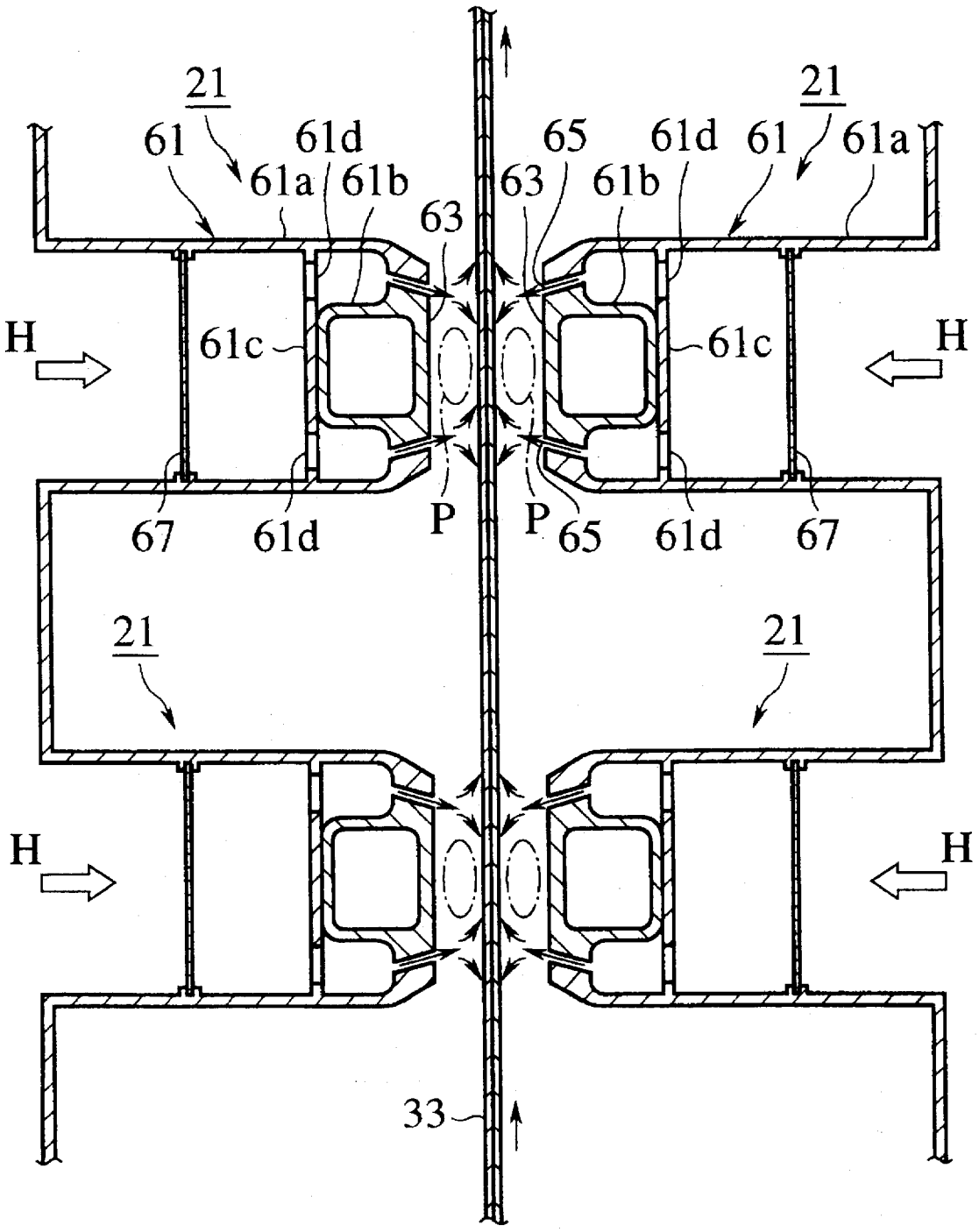
FIG. 3 is a sectional view of air-blowing nozzles and their peripheral area of the first embodiment according to the presnt invention.
Figure 4:
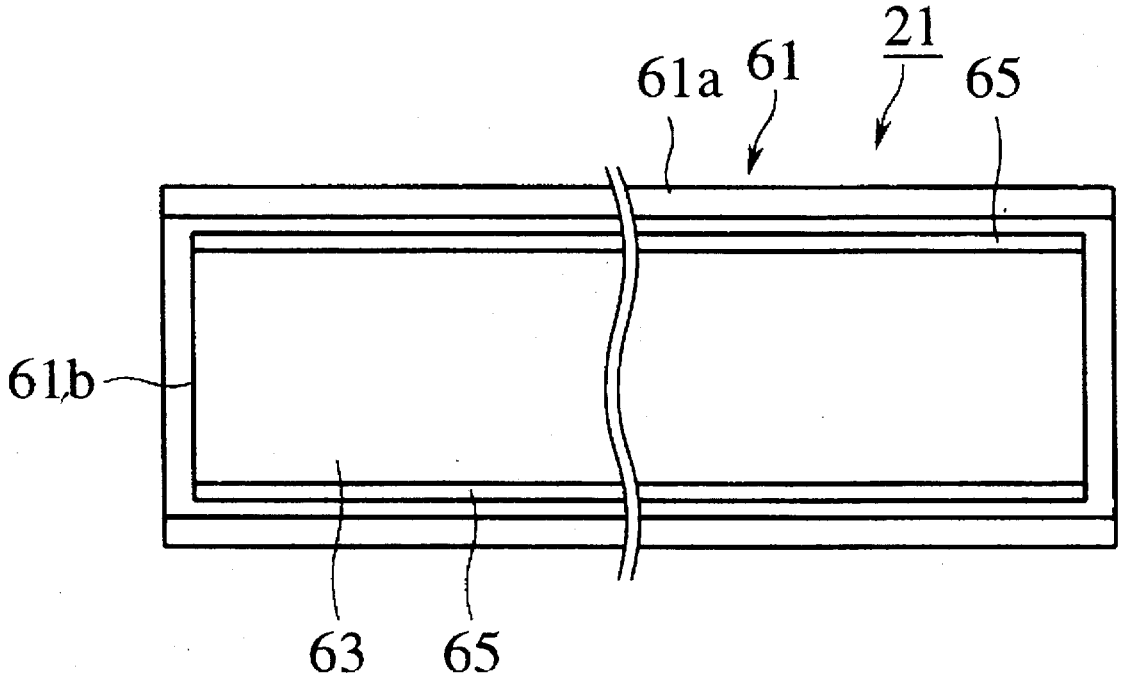
FIG. 4 is a front view of an air-blowing nozzle in FIG. 3.
Figure 5:
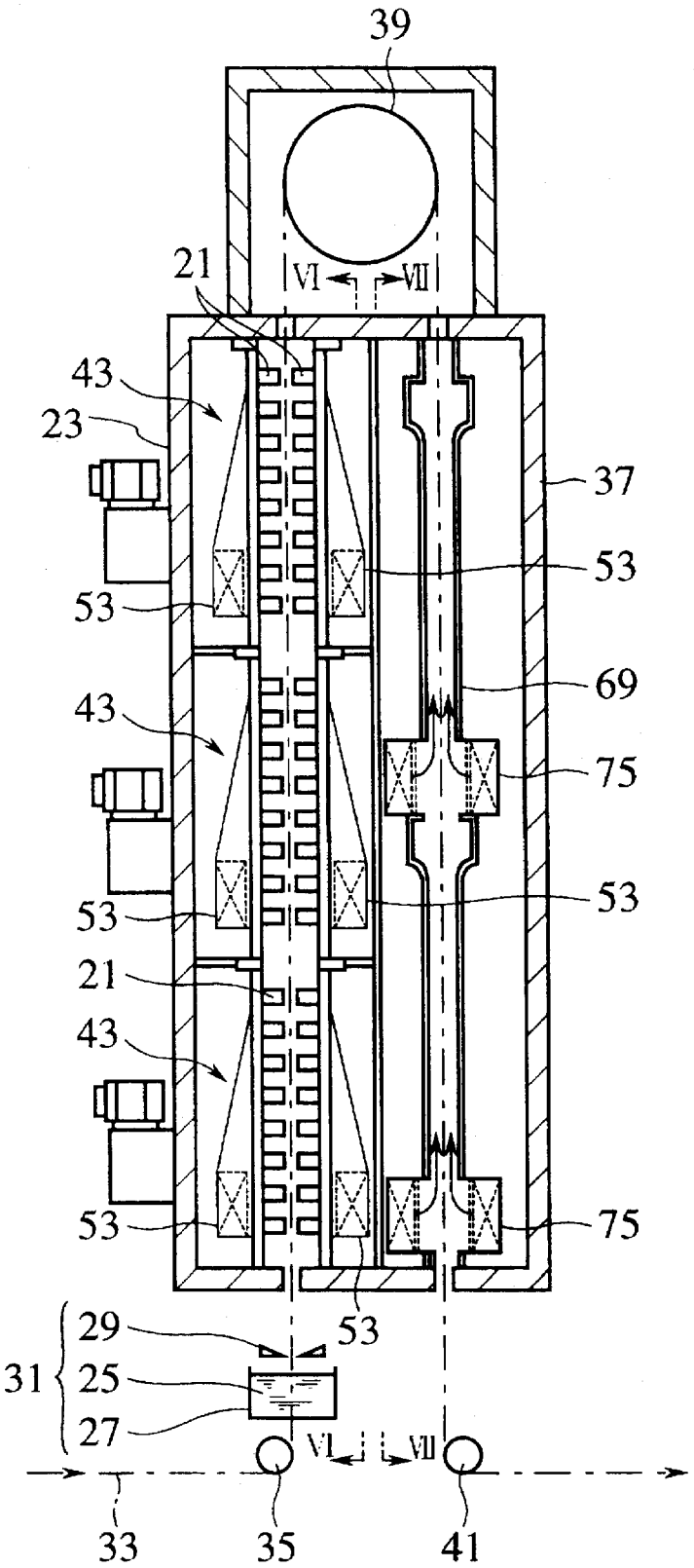
FIG. 5 is a figure of internal structure of a drying apparatus provided with plural air-blowing nozzles.
Figure 6:
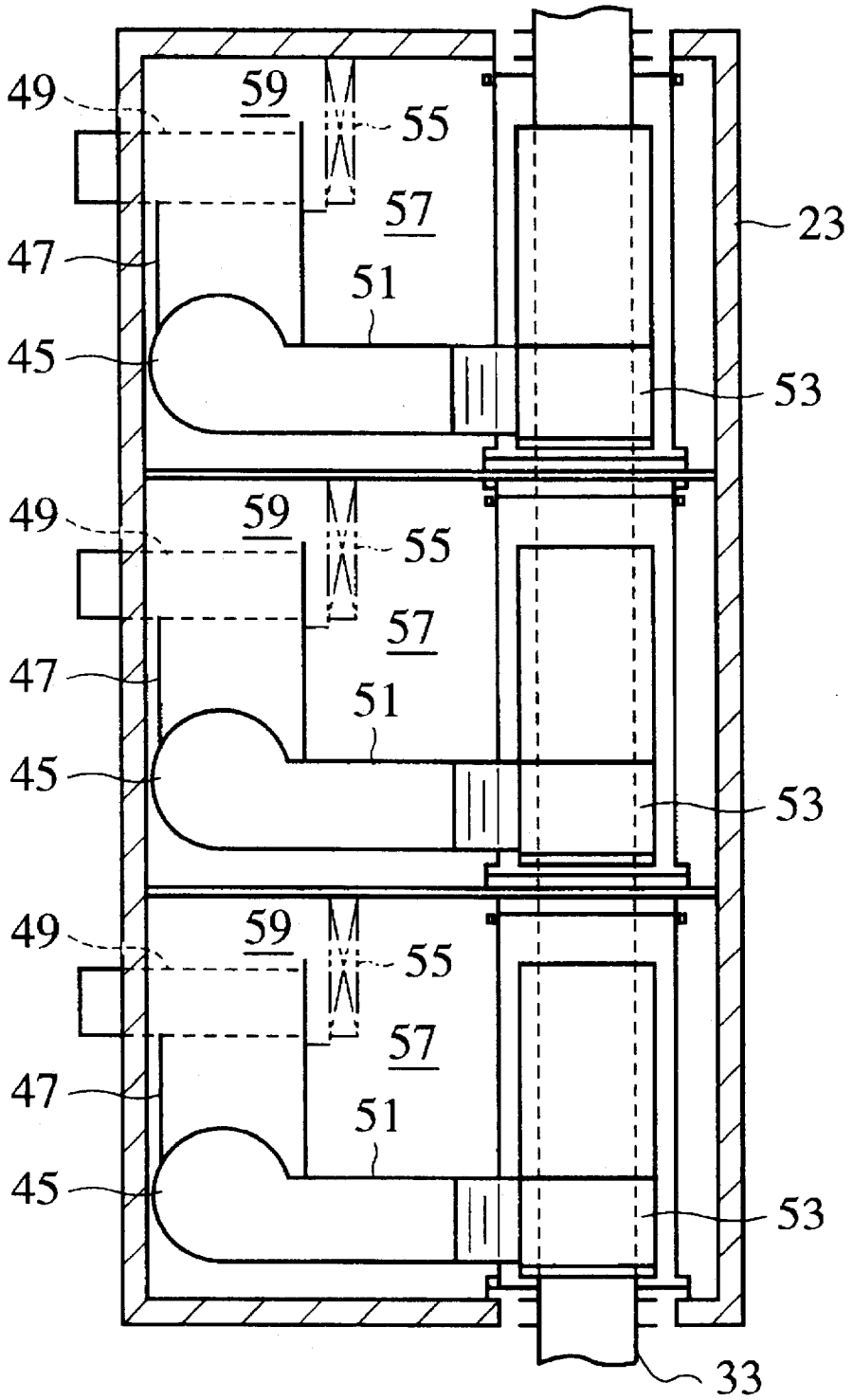
FIG. 6 is a left-side sectional view of the main part in FIG. 5.
Figure 7:
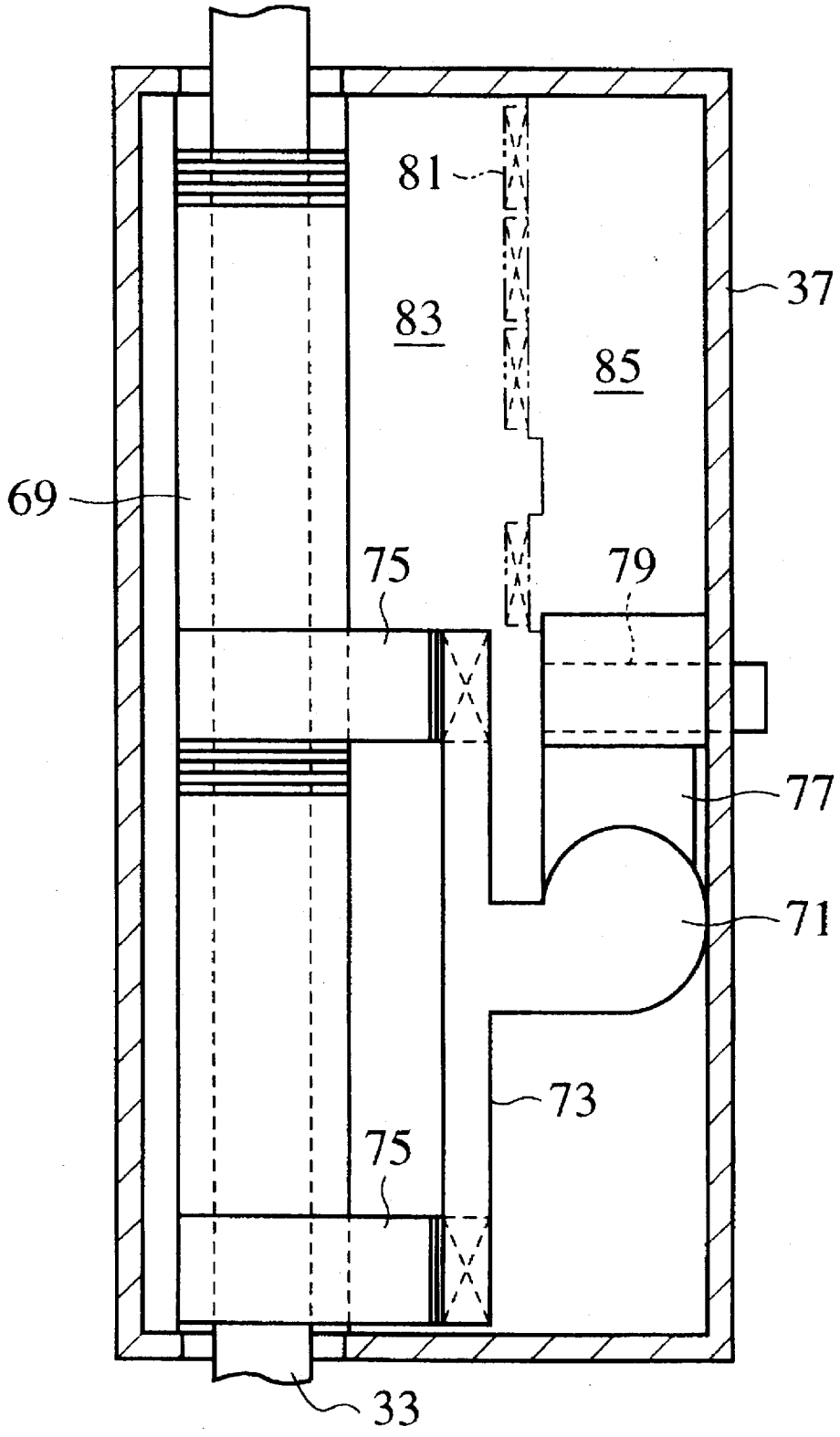
FIG. 7 is a right-side sectional view of the main part in FIG. 5.

FIG. 3 is a sectional view of air-blowing nozzles 21 and their peripheral area in a dryer showing a first embodiment of the invention, FIG. 4 is a front view of an air-blowing nozzle 21 in FIG. 3, FIG. 5 is a figure of internal structure of a dryer 23 provided with plural air-blowing nozzles 21 inside it and its peripheral area, FIG. 6 is a left-side sectional view of only the dryer 23 in FIG. 5, and FIG. 7 is a right-side sectional view of only the drying furnace 37 in FIG. 5. The dryer 23 is used for an electrode sheet used for a hydrogen electrode in the cathode side of a nickel-hydrogen battery.

Figure 1:
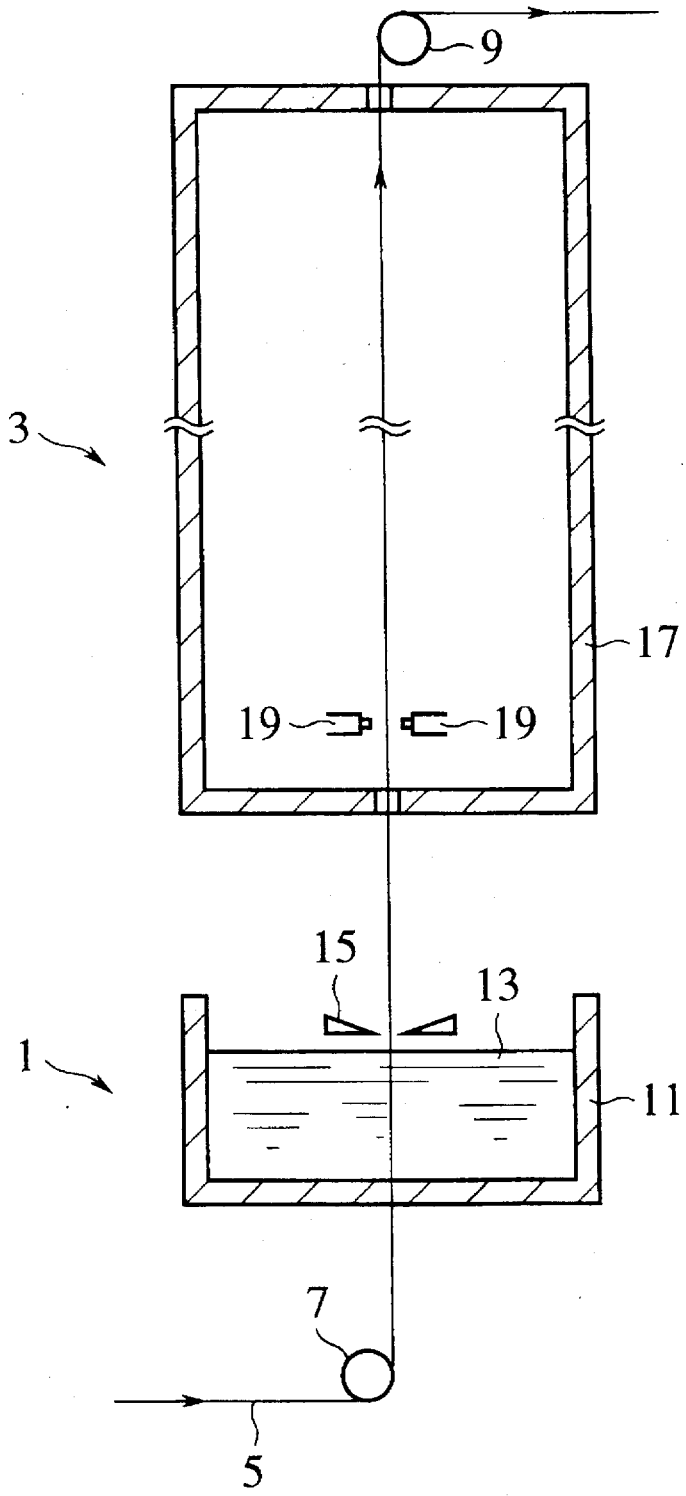
FIG. 1 PRIOR ART
FIG. 1 is an explanatory view for showing schematically a process of applying an electrode compounding agent to an electrode sheet and drying it according to the first conventional example.
Figure 2:
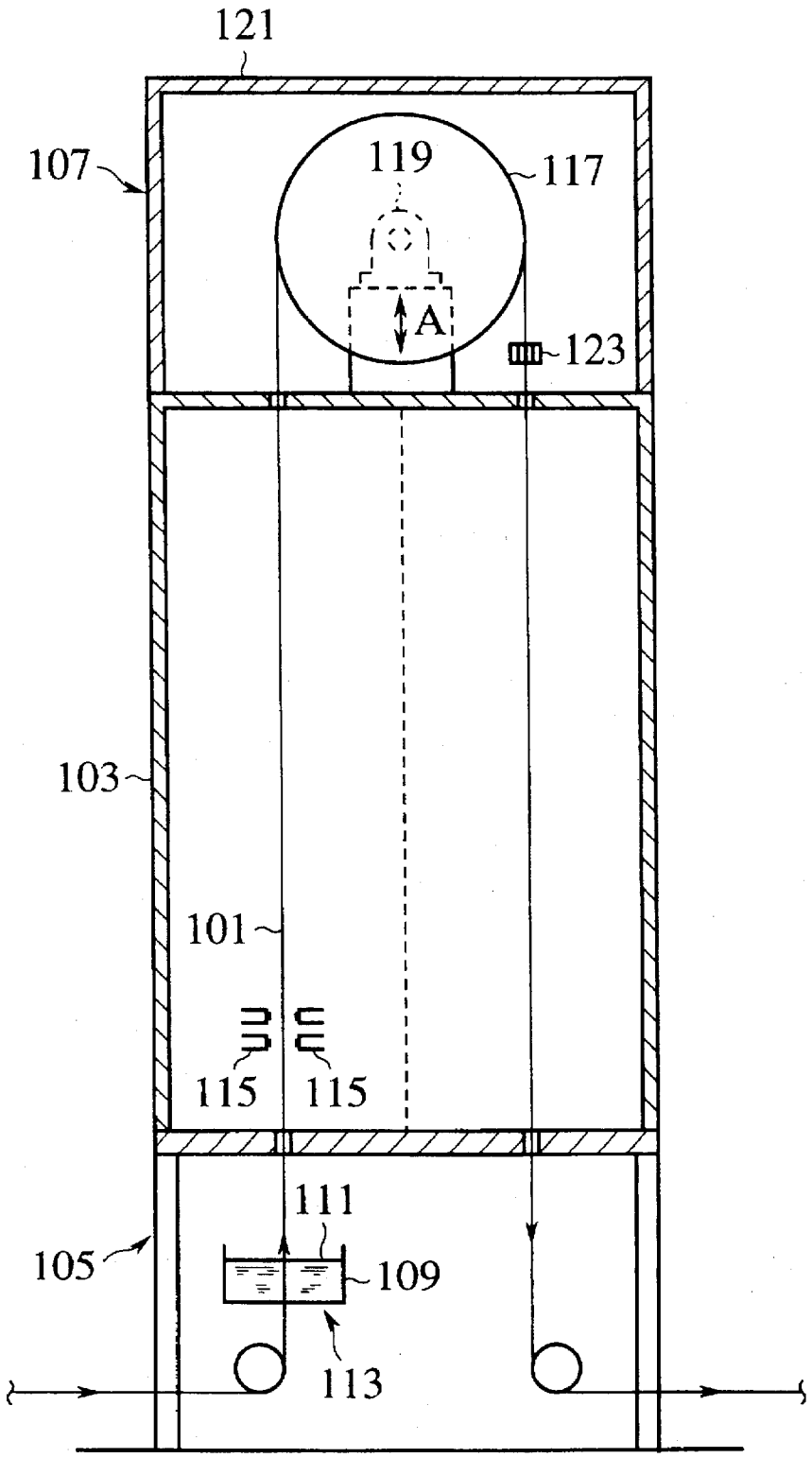
FIG.2 PRIOR ART
FIG. 2 is a front sectional view of the second conventional example of a skew-movement preventing apparatus used for a drying apparatus.

In FIG. 5, a coater 31 provided with a vessel 27 filled with an electrode compounding agent 25 as a coating liquid and blades 29 is disposed below the dryer 23 similarly to the existing example shown in FIG. 1, and the electrode compounding agent is applied to both surfaces of an electrode sheet 33 as a flexible beltlike sheet while the electrode sheet 33 is passing through the coater 31 through an entrance roller 35. The electrode sheet 33 to which the electrode compounding agent has been applied in the coater 31 proceeds upward and enters into a dryer 23 and then changes its proceeding direction with a turn roller 39 provided on the top of the dryer 23. The electrode sheet 33 which has changed its proceeding direction proceeds downward and enters again into the dryer furnace 37 and then moves to the outside through an exit roller 41 provided below the drying furnace 37.

Figure 8:
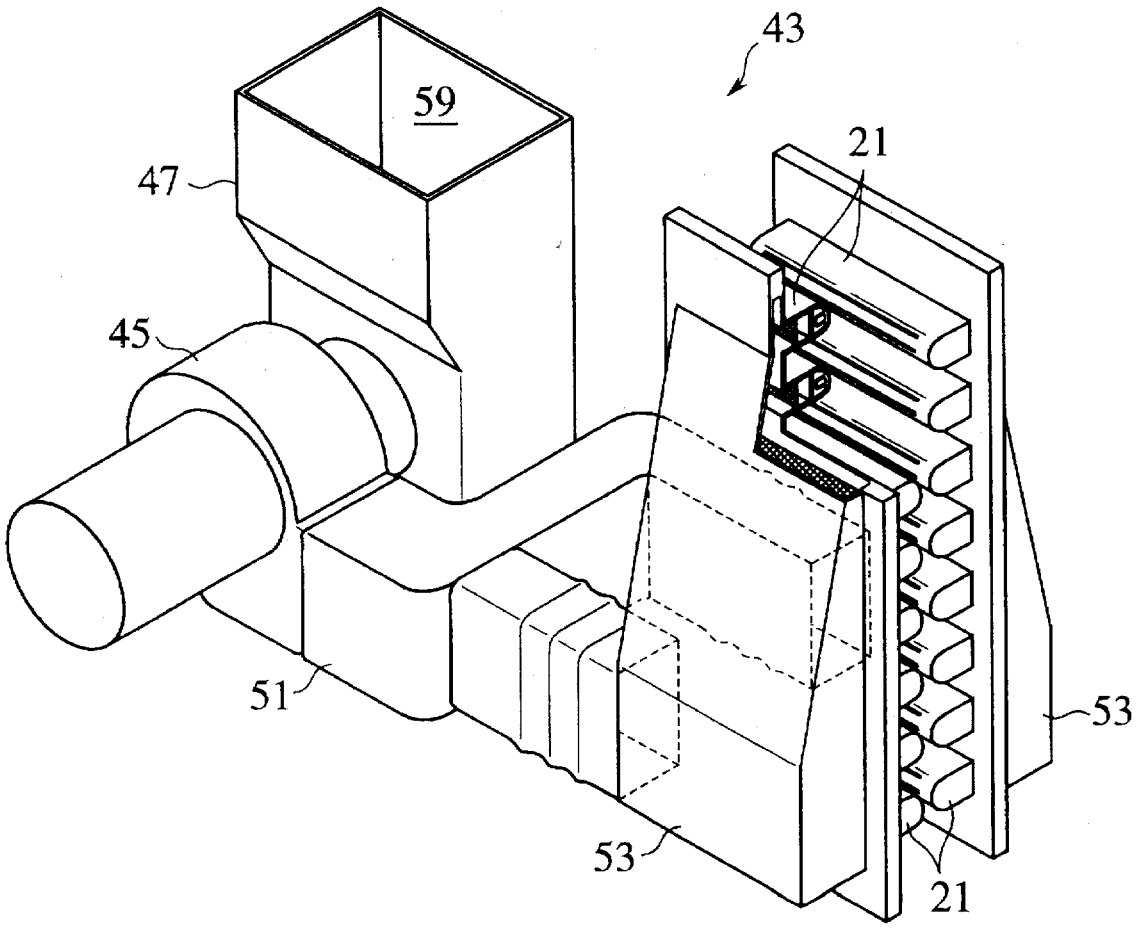
FIG. 8 is a perspective view of a nozzle unit provided with the air-blowing nozzles shown in FIG. 3.

Air-blowing nozzles 21 shown in detail in FIG. 3 are provided in both left and right sides of the position shown in FIG. 5 where the electrode sheet 33 is moving upward in the dryer 23. Plural air-blowing nozzles are provided almost all over the path along which the electrode sheet 33 moves upward from the lower end face to the upper end face of the drying furnace 37. These plural air-blowing nozzles 21 are divided into three groups along the moving path of the electrode sheet 33, and the air-blowing nozzles 21 belonging to each of the three groups are accommodated in a nozzle unit 43 as shown in FIG. 8.

In the nozzle unit 43, an electric heater 49 is provided inside an entrance duct 47 in the upper stream side of a blower 45 and an exit duct 51 in the lower stream side of the blower 45 is forked into two branches. This forked exit duct 51 is linked to the respective left and right air-blowing nozzles 21 through the respective guide ducts 53. The entrance duct 47 is opened into an entrance space 59 partitioned by a filter 55 from a furnace space 57 as shown in FIG. 6, and the air which is heated by the electric heater 49 and is blown off from the air-blowing nozzles 21 spreads out in the furnace space 57 and enters into the entrance duct 47 from the entrance space 59 through the filter 55. In this way, although the air sent from the blower 45 is circulated through the filter 55, an exhaust port, which is not illustrated, opened to the outside for coercively exhausting by means of a fan and the like is provided in order to prevent the moisture in the electrode compounding agent applied to the electrode sheet 33 from evaporating and condensing into dew, and an air introducing port for introducing an amount of air equivalent to the air exhausted from this exhaust port is provided so as to be opened to the entrance space 59.

As shown in FIGS. 3 and 4, in the air-blowing nozzle 21, a pair of slit-shaped blowholes extended along the width direction of the electrode sheet 33 are provided on both sides of the end face part 63 of a nozzle body 61 so that the two slit-shaped blowholes may be disposed one behind another in the conveying direction of the electrode sheet 33. The nozzle body 61 has a main body 61*a* and a nozzle end part 61*b* which forms a pair of upper and lower blowholes 65 between the main body 61*a* and the nozzle end part 61*b* itself by being inserted into an opening in the end side of the nozzle body 61, and the nozzle end part 61*b* is fixed on a partition wall 61*c* formed inside the main body 61*a* at its rear end. Vents 61*d* are formed in the partition wall 61*c* and an adjusting plate 67 having a number of little holes is provided furthermore in the upper stream side in the main body 61*a*.

It is assumed that two air-blowing nozzles 21 which are opposite to each other in both sides of the electrode sheet 33 are at a distance equal to each other, respectively, from the coated surfaces of the electrode sheet 33 and are also equal to each other in blowing speed.

A vertical duct 69 covering the electrode sheet 33 all over the total length of the electrode sheet 33 in its moving direction is provided in an area where the electrode sheet 33 moves downward inside the drying furnace 37. An exit duct 73 in the downstream side of the blower 71 is linked to the vertical duct 69 through connecting ducts 75 in the middle and lower parts of the vertical duct 69, and an electric heater 79 is provided in an entrance duct 77 in the upper stream side of the blower 71.

The entrance duct 77 is opened into an entrance space 85 partitioned by a filter 81 from a furnace space 83, and the air which has been heated by the electric heater 79 and has been sent from the blower 71 and has flowed into the vertical duct 69 flows into the furnace space 83 through a non-illustrated connecting hole formed in the vertical duct 69 and flows into the entrance duct 77 from the entrance space 85 through the filter 81. A coercive exhaust port communicating with the outside is provided in the furnace space 83 and an air introducing port is provided in the entrance space 85, although they are not illustrated, and they make it possible to prevent the moisture contained in the electrode compounding agent applied to the electrode sheet 33 from evaporating and condensing into dew.

In the dryer as composed above, in a process that the electrode sheet 33 both surfaces of which the electrode compounding agent has been applied to is conveyed upward from downward in FIG. 5, the air heated by the electric heater 49 is supplied to the air-blowing nozzles 21 as a hot air H, as shown in FIG. 3, through the exit duct 51 and the guide path 53 from the blower 45. The hot air H supplied to the air-blowing nozzles 21, after being adjusted by the adjusting plate 67, passes through the vents 61*d*, is blown off from the blowholes 65 to blow against the electrode sheet 33 and dries the applied electrode compounding agent.

A part of the hot air blown against the electrode sheet 33 flows along the coated electrode sheet 33 outward from the air-blowing nozzle 21 and the other part of it flows along the sheet 33 inward from the air-blowing nozzle 21, and the hot air flowing inward from a pair of upper and lower blowholes out of them pressurizes a space between the electrode sheet 33 and the end face part 63 to form a pressure room P.

Since the pressure rooms P are in both sides of the electrode sheet 33 by the left and right pairs of air-blowing nozzles 21, the pressure room P in both sides holds the electrode sheet 33 to prevent the electrode sheet 33 from swaying. According to this configuration, a blowing speed of the air-blowing nozzle 21 can reach up to 30 m/sec, but as an example of actual use, the blowing speed set at about 15 m/sec depending upon capability of apparatus before or after the dryer can attain a high-speed blowing operation three times faster than an existing speed of 5 m/sec while preventing the sheet from swaying and so it can contribute to improvement in drying efficiency.

Since swaying of the electrode sheet 33 is suppressed, the conveying speed of the electrode sheet 33 can be also increased several times higher than an existing speed and a drying time can be shortened to improve the drying efficiency. And thanks to improvement in drying efficiency, since the dryer 23 can be made lower in height, it is possible to make the drying furnace smaller as well as to keep less swaying of the electrode sheet 33 thanks to reducing the dryer 23 in height.

Furthermore, thanks to suppressing sway of the electrode sheet 33, it is possible to prevent unevenness in thickness of the coated film caused by swaying of it inside the dryer 23 as well as to obtain a uniform coated surface in a coating process by the coater 31.

Still further, it is possible to cope with variation of the speed of a blowing air by adopting a configuration where the left and right air-blowing nozzles 21 can be moved close to and apart from the electrode sheet 33 while keeping the left and right air-blowing nozzles 21 at a distance equal to each other from the electrode sheet 33.

Although the above-mentioned embodiment has shown an example of applying the air-blowing nozzles 21 to a dryer used for an electrode sheet for a hydrogen electrode in the cathode side in a nickel-hydrogen battery, the same effect can be obtained by applying them to a dryer used for an electrode sheet for a nickel electrode in the anode side, an electrode sheet for other batteries, or a flexible beltlike sheet other than an electrode sheet.

Next, a second embodiment of the present invention is described in the following.

Figure 9:
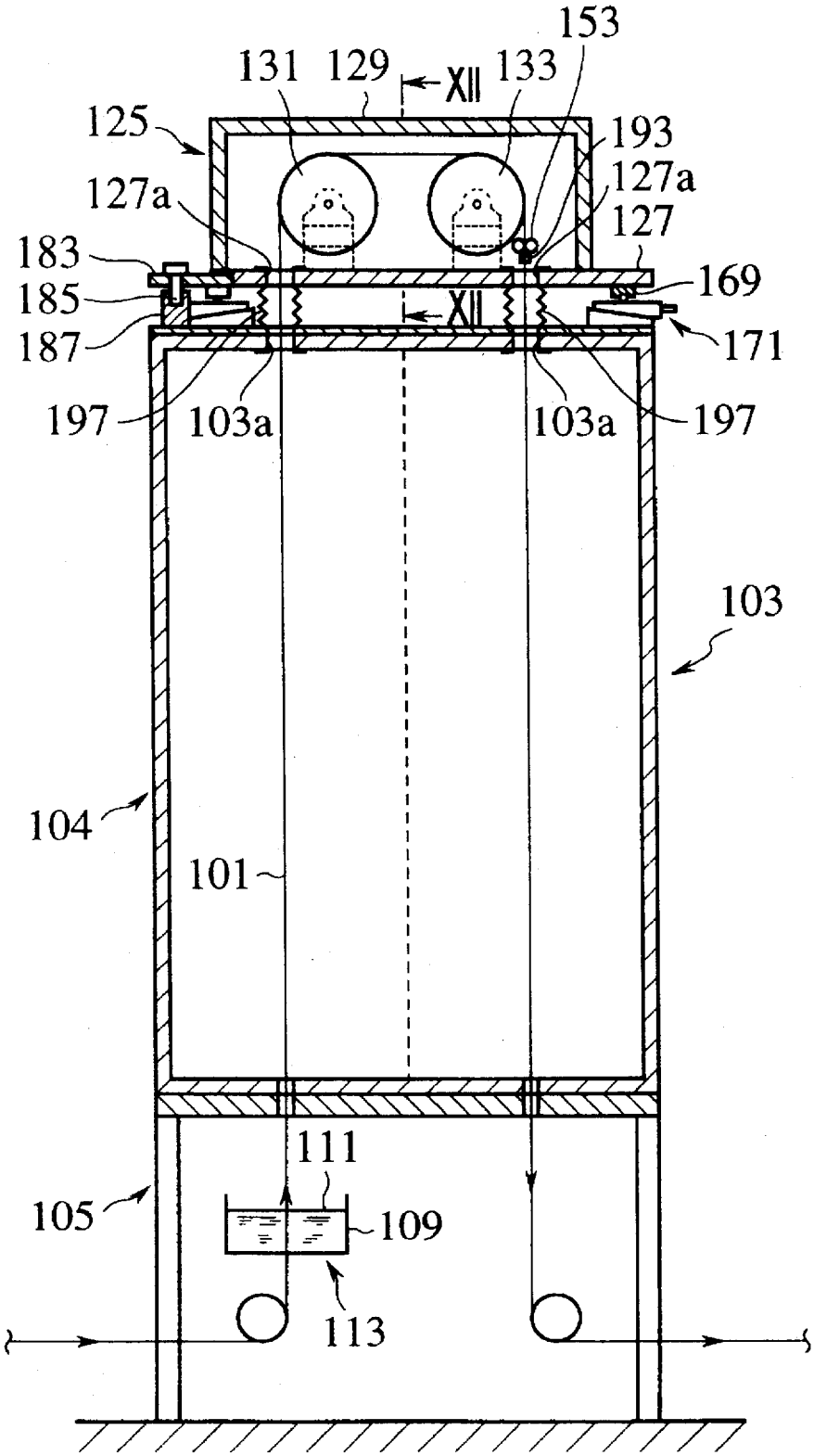
FIG. 9 is a front sectional view of a skew-movement preventing apparatus used for a drying apparatus for showing the second embodiment of the present invention.

FIG. 9, which is related to an embodiment of the invention, shows schematically a drying process and its peripheral area for drying an electrode compounding agent applied to an electrode sheet 101 which is a beltlike sheet in the same way as the above-mentioned FIG. 8. In this case, the composition of a turn part 125 provided on the top of the drying furnace 103 is different from that of FIG. 8 and the composition of the other part is the same as that of FIG. 8.

Figure 10:
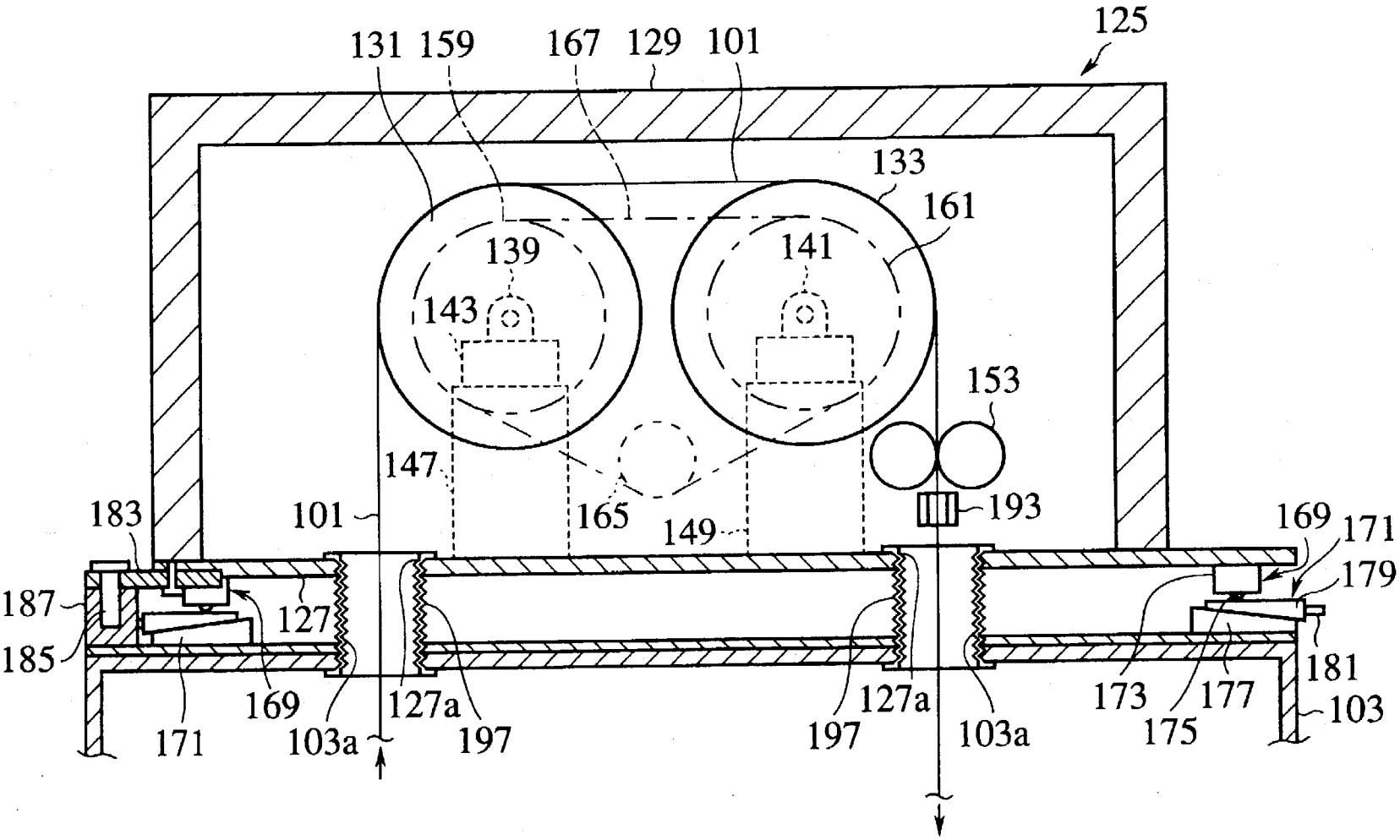
FIG. 10 is a sectional view of a skew-movement preventing apparatus provided on the top of the drying furnace shown in FIG. 9.
Figure 11:
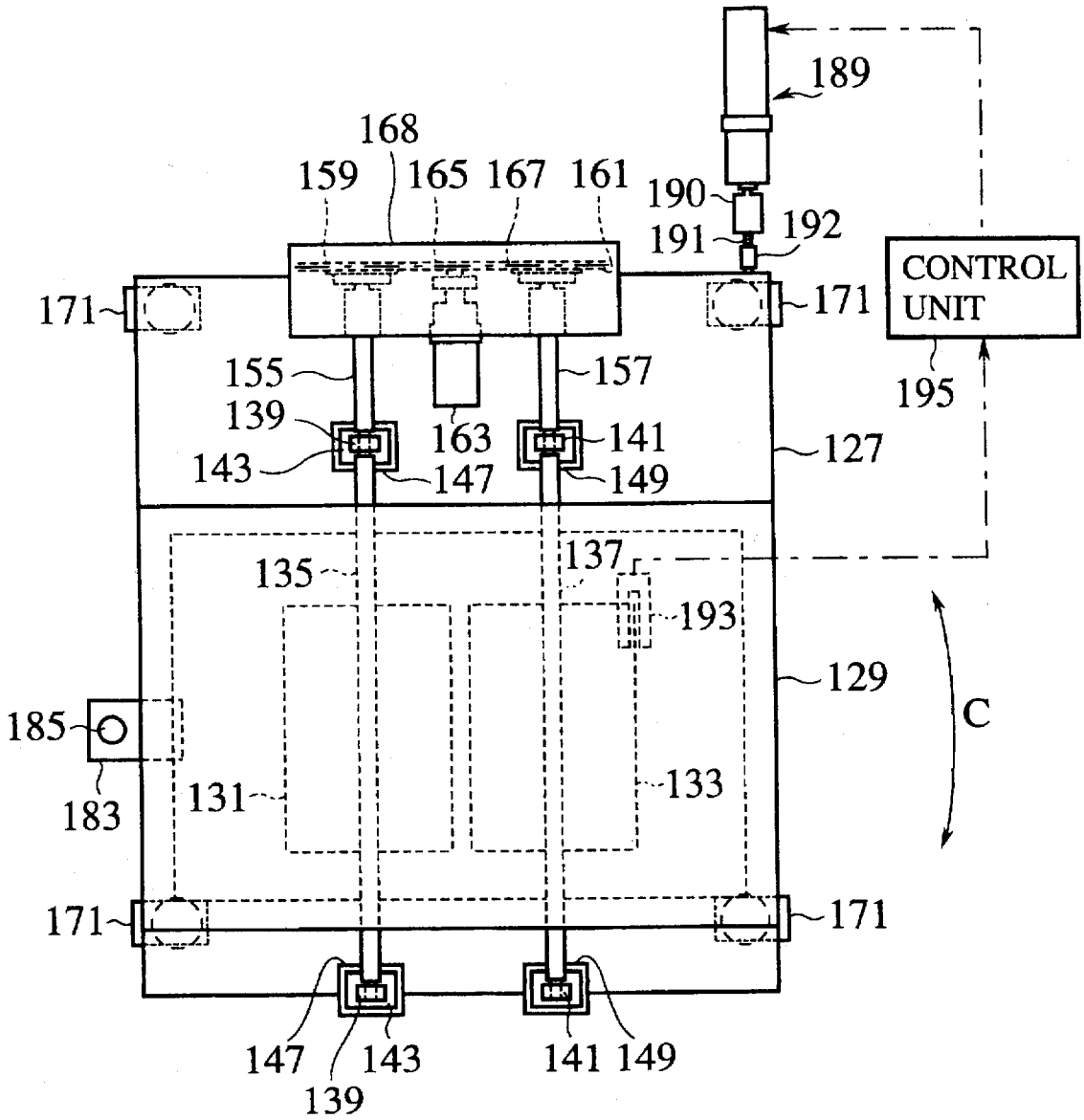
FIG. 11 is a plan view of the skew-movement preventing apparatus shown in FIG. 9.
Figure 12:
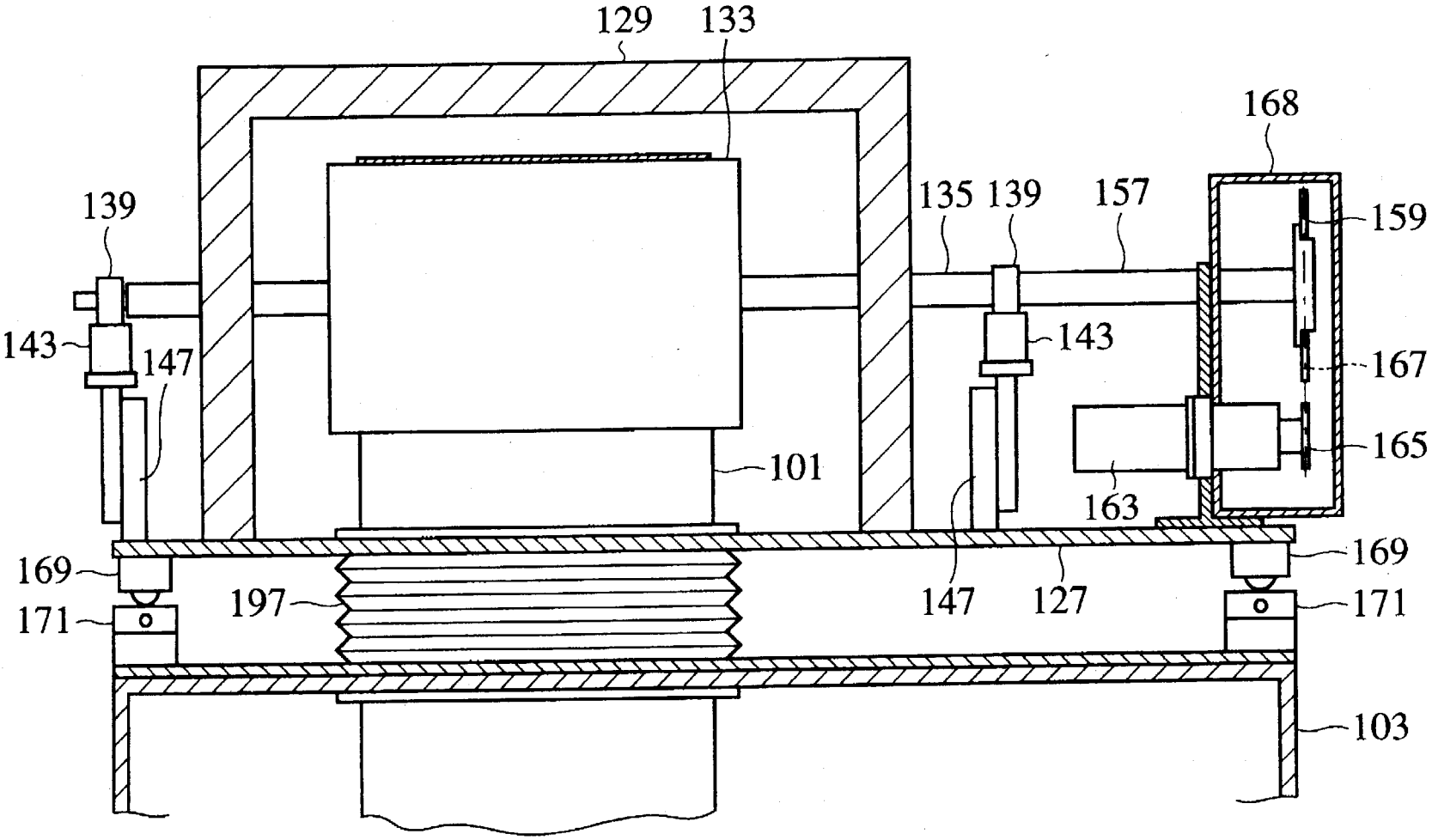
FIG. 12 is a sectional view taken on line XII—XII in FIG. 9.

The turn part 125 is described in detail in the following. FIG. 10 is a front sectional view of the turn part 125 in FIG. 9 for showing it in detail, FIG. 11 is a plan view of it, and FIG. 12 is a sectional view of it taken along line XII—XII in FIG. 9. The turn part 125 is provided with an entrance roller 131 to turn the electrode sheet 101 coming up from the dryer 104 to the horizontal direction and an exit roller 133 to turn the electrode sheet 101 being sent from the entrance roller 131 to the downward direction to send it into the drying furnace 103 inside a heat-isolating hood 129 which forms a housing in conjunction with a base 127 on which the heat-isolating hood 129 is fixed. The rollers 131 and 133 are respectively fixed on rotating shafts 135 and 137 inserted so as to rotate in the heat-isolating hood 129, and the rotating shafts 135 and 137 are supported so as to rotate by bearings 139 and 141 at both ends of the rotaing shafts 135 and 137 protruding from the heat-isolating hood 129. The base 127, the heat-isolating hood 129, the bearings 139 and 141, and the like compose a supporting structure for covering and supporting the rollers 131 and 133.

The bearings 139 in the entrance roller 131 side are provided on tension detectors 143 for detecting tension of the electrode sheet 101, and the tension detectors 143 are set on supporting blocks 147 fixed on the base 127. On the other hand, the bearings 141 in the exit roller 133 side are provided on supporting blocks 149 fixed on the base 127.

The tension detector 143 detects tension of the electrode sheet 101 by converting a displacement caused by a resultant force into an electric signal by means of a differential transformer, which resultant force is composed of a force acting downward and a force acting rightward to draw the electrode sheet 101 against the entrance roller 131 in FIG. 10. A pair of tension-adjusting rollers 153 as a tension adjuster are provided in both sides of the electrode sheet 101 immediately after being sent out from the exit roller 133 inside the turn part 125. The pair of tension-adjusting rollers 153, one of which is driven by a non-illustrated motor, adjust the tension of the electrode sheet 101 so as to give a specified tension by adjusting a feeding speed of the electrode sheet 101 on the basis of a detection value of the tension detector 143.

Connecting shafts 155 and 157 are fixedly connected with the right end parts respectively of the rotating shafts 135 and 137 in FIG. 12, and the end parts are fitted with sprocket wheels 159 and 161, respectively. A driving motor 163 is set between the connecting shafts 155 and 157 on the base 127, and a driving sprocket wheel 165 connected with a driving shaft of the driving motor 163 and the sprocket wheels 159 and 161 are linked with a chain 167. These sprocket wheels 159, 161 and 165, and the chain 167 are contained inside a case 168.

The base 127 is fitted with ball casters 169 on the four corners of its lower surface in FIG. 10, and leveling blocks 171 on which the ball casters 169 are set are disposed as height-adjusting mechanisms on the upper surface of the drying furnace 103 as corresponding to the ball casters 169, respectively. Each of the ball casters 169 contains a spherical ball 175 which can rotate inside a holder 173 fixed on the lower surface of the base 127, and the ball 175 rolls on the leveling block 171. Each of the leveling blocks 171 is composed of a fixed block 177 which is fixed on the drying furnace 103 and has a slope on its upper surface and a movable block 179 which has a slope closely touching the slope of the fixed block 177, and adjusts height of the turn part 125 at each of the four corners of it in relation to the dryer 104 by adjusting an adjusting screw 181 provided on the movable block 179 to slide the movable block 179 along the slope on the fixed block 177.

In FIG. 9, a supporting plate 183 is set projectingly on the left side part of the base 127, and a supporting shaft 185 to be a pivot fixed on the supporting plate 183 is inserted so as to be rotated into a supporting cylinder 187 fixed on the upper surface of the dryer 104. Thus, the turn part 125 including the base 127 can be swivelled around the supporting shaft 185 in the direction of arrow C in FIG. 11.

On the other hand, a motor 189 for swivelling as a driving mechanism provided with a reduction gear is set on the drying furnace 103 in the upper position at the upper right corner of the base 127 in FIG. 11. A screw part 191 at the end of a driving shaft 190 joined with the reduction gear of the swivelling motor 189 is screwed into a nut 192 with a spherical bearing provided in the base 127 side. The nut 192 is fixed in the direction of rotating the screw 191 and is fixed on the side part of the base 127 so as to follow a swivelling movement of the base 127, and the nut 192 is moved by rotation of the screw part 191 with operation of the swivelling motor 189, and the base 127 is swivelled with this movement.

An edge position control (EPC) sensor 193 as a position detector for detecting a position of the electrode sheet 101 in the width direction is provided, as shown in FIGS. 9 and 10, at one of the edge parts of the electrode sheet 101 in its width direction (in the direction perpendicular to the present paper sheet in FIG. 9), which edge parts are more downstream than the tension adjusting rollers 153 which are immediately after the exit roller 133. The EPC sensor 193 is provided with a detector provided with a nozzle as an air-blowing blowhole for blowing air against an edge part of the electrode sheet 101 from one side of it and a sensing orifice as a sensing part for the air blown off from the nozzle, and catches variation of a wind pressure, which the sensing orifice receives as a result of obstructing the blowing air with the edge part of the electrode sheet 101, as variation of the position of the electrode sheet 101. And a controller 195 controls operation of the swivelling motor 189 according to variation of the wind pressure, namely, according to an amount of slippage of the electrode sheet 101 in its width direction.

Through slits **103*a* and 127*a* which the electrode sheet 101 passes through are formed respectively in the top wall of the drying furnace 103 and in the base 127, and the through slits 103*a* and 127*a* are linked with one another by means of heat-resistant bellows 197** as elastically transformable ducts.

In a skew-movement preventing apparatus composed as described above, the electrode sheet 101 both surfaces of which an electrode compounding agent has been applied to is conveyed into the turn part 125 as drying the electrode compounding agent while moving upward and passing through inside the dryer 104. In the turn part 125, the entrance roller 131 and the exit roller 133 which are rotated in the same direction by the driving motor 163 draw up the electrode sheet 101 as well as change its proceeding direction and then send it into the dryer 104.

In the above-mentioned process of conveying the electrode sheet 101, the EPC sensor 193 detects a position of an edge part of the electrode sheet 101 in its width direction, and on the basis of this detection value the controller 195 controls the swivelling motor 189 to adjust a swivelling speed or a swivelling range of the turn part 125. Since swivelling of the turn part 125 swivels also the entrance roller 131 and the exit roller 133 which are provided on the base 127, in case that the electrode sheet 101 skews or deviates in the width direction (in the direction perpendicular to the present paper sheet in FIG. 9) when the electrode sheet 101 is conveyed, this skew movement of the electrode sheet 101 is corrected to return to its regular position so that a proper conveying operation may be performed.

In case of performing a skew-movement prevention by swivelling the entrance roller 131 and the exit roller 133 in the horizontal direction as described above, differently from a case of moving them upward and downward as in the prior art, a tension difference does not happen between the upward moving part and the downward moving part of the electrode sheet 101 having the turn part 125 as a boundary between them, and therefore, a horizontal sway problem in the prior art caused by an influence of a hot wind upon the lower-tension side of the electrode sheet 101 inside the dryer 104 can be prevented and as a result, it is possible to attain a coating film on the electrode sheet which is uniform in thickness.

Since the ball 175 of the ball caster 169 rolls on the leveling block 171, a swivelling action of the turn part in the horizontal direction is smoothly performed and a skew movement can be easily corrected.

Since the inside of the heat-isolating hood 129 of the turn part 125 is linked with the inside of the dryer 104 through the bellows 197, the temperature inside the heat-isolating hood 129 can be kept nearly equal to the temperature inside the dryer 104 and so the coated surfaces of the electrode sheet 101 do not receive a bad influence by a temperature variation. And since the bellows 197 can be elastically transformed, they can follow a swivelling action of the turn part 125, and therefore, the linking state of the inside of the dryer furnace 103 and the inside of the heat-isolating hood 129 is preferably secured.

Since temperature inside the dryer 104 is raised to about 250° C., the top plate of the dryer 104 on which the turn part 125 is mounted is thermally transformed, but the turn part 125 can be kept at a level as a whole by adjusting inclination of the entire turn part 125 caused by this transformation by means of the adjusting screws 181 of the leveling blocks 171 on the four corners of the top plate of the dryer 104, and so this thermal transformation does not interfere with an operation of conveying the electrode sheet 101. Although the EPC sensor 193 is set inside the heat-isolating hood 129 where is as hot as inside the dryer 104, since the sensor 193 is of pneumatic type, it is hard to receive a thermal influence and its detection accuracy is kept at a desirable level.

Since the bearings 139 and 141 supporting the entrance roller 131 and the exit roller 133 so as to be rotated are provided outside the heat-isolating hood 129 which is kept at a high temperature, their bearing function can be preferably secured. Since the tension detector 143 is also mounted outside the heat-isolating hood 129 together with the bearings 139 and 141, it can detect accurately tension of the electrode sheet 101 without receiving a thermal influence, and on the basis of this tension-detection value the tension-adjusting rollers 153 act so as to keep tension of the electrode sheet 101 at a specified value.

Since gaps which the inside of the heat-isolating hood 129 is opened to the outside of it through are only the areas through which the rotating shafts 135 and 137 pierce to the outside, the heat-isolating hood 129 is well sealed and is very good in heat-isolating ability.

What is claimed is:

1. A drying apparatus in which a flexible beltlike sheet, on which a coating liquid has been applied to both of opposite surfaces, is conveyed in the vertical direction and the coating liquid is dried during conveying in the vertical direction, said drying apparatus comprising:

air-blowing nozzles disposed opposite to one another at a distance from the beltlike sheet on which the coating liquid has been applied, each air-blowing nozzle having an end face part facing said beltlike sheet and located vertically between slit-shaped blowholes extended in the direction of width of said beltlike sheet.

2. A drying apparatus as claimed in claim 1, wherein said beltlike sheet is an electrode sheet for a battery to both surfaces of which an electrode compounding agent is applied.

3. A drying apparatus as claimed in claim 1 or 2, wherein said air-blowing nozzles can be moved toward and away from said beltlike sheet.

* * * * *